United States Patent [19]

Frayer et al.

[11] 4,179,354

[45] Dec. 18, 1979

[54] COMBINATION RESIDUAL OIL HYDRODESULFURIZATION AND CATALYTIC CRACKING PROCESS

[75] Inventors: James A. Frayer, Pittsburgh; Harry C. Stauffer, Cheswick; Stephen J. Yanik, Valencia, all of Pa.

[73] Assignee: Gulf Research and Development Company, Pittsburgh, Pa.

[21] Appl. No.: 843,878

[22] Filed: Oct. 20, 1977

[51] Int. Cl.[2] ..... C10G 23/02

[52] U.S. Cl. ..... 208/89; 208/210

[58] Field of Search ..... 208/89, 210

[56] References Cited

U.S. PATENT DOCUMENTS

| | | | |
|---|---|---|---|
| 3,617,526 | 11/1971 | Coons, Jr. et al. | 208/210 |
| 3,781,197 | 12/1973 | Bryson et al. | 208/89 |
| 3,936,370 | 2/1976 | Henke et al. | 208/210 |
| 3,968,027 | 7/1976 | Frayer et al. | 208/210 |

*Primary Examiner*—George Crasanakis

[57] ABSTRACT

When residual oil is cracked to gasoline in the presence of a fluidized zeolite catalyst the oil is first catalytically hydrodesulfurized so that sulfur oxide emissions from the catalyst regenerator are held to environmentally acceptable levels. The hydrodesulfurized residual oil is flash vaporized at the elevated temperature at the inlet of the cracking riser and most of the residual oil feedstock passes into the vapor state and is cracked to valuable products. However, a portion of the 1050° F.+ (566° C.+) residual material cannot be flash vaporized at the riser temperature and instead deposits upon the catalyst and is coked. Data are presented which show that as the proportion of the 1050° F.+ (566° C.+) components in a cracking feedstock decreases, the amount of these high boiling components in each barrel of cracker feedstock which are flash vaporized can actually increase. A multistage hydrodesulfurization operation is provided in which the proportion of 1050° F.+ (566° C.+) residual components in the cracking feedstock is diminished whereby the amount of 1050° F.+ (566° C.+) residuals vaporized per barrel of feedstock during the subsequent cracking step is increased. The present method provides an interdependent advantage in the hydrodesulfurization operation since it reduces hydrogen consumption during hydrodesulfurization.

16 Claims, 5 Drawing Figures

COMBINATION RESIDUAL OIL HYDRODESULFURIZATION AND CATALYTIC CRACKING PROCESS

Figure 1:
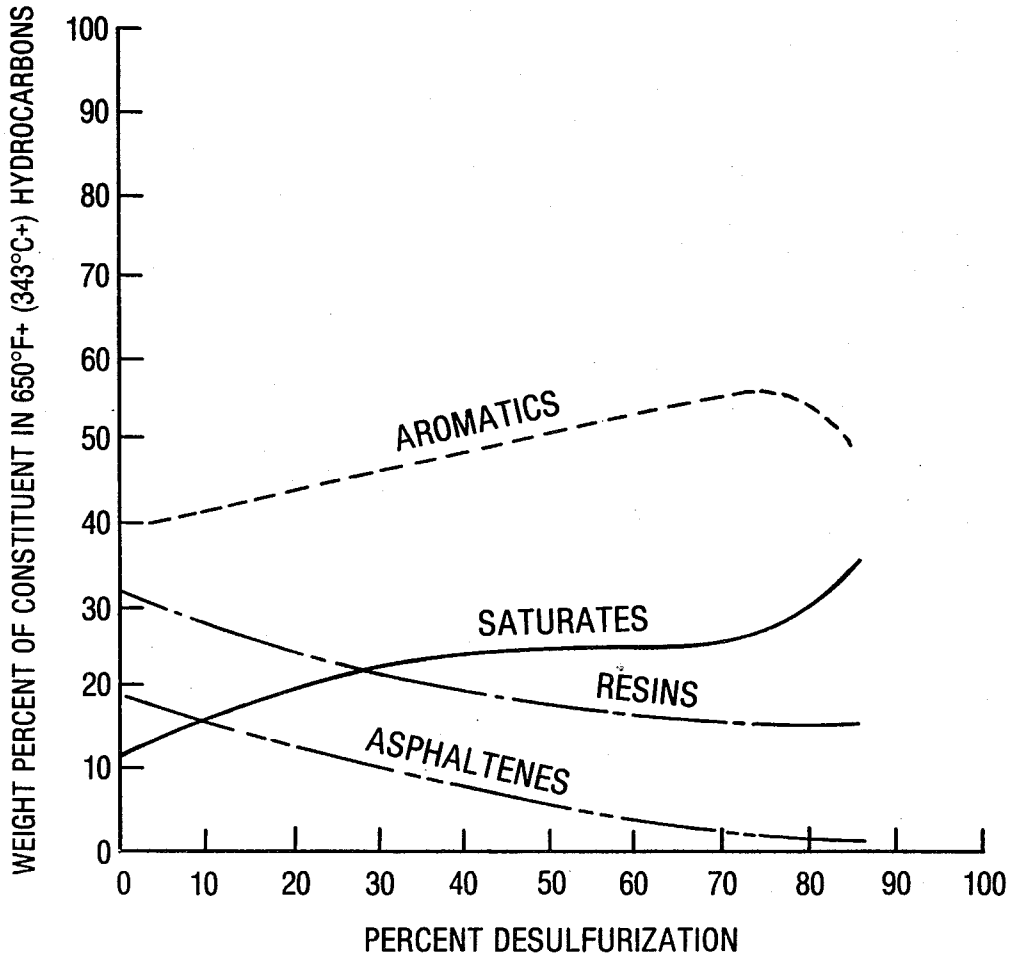

This invention relates to a combination process including hydrodesulfurization and zeolitic cracking of residual oils containing metals, sulfur and asphaltenes.

The hydrodesulfurization operation employed is highly interdependent with respect to the zeolitic cracking operation. The hydrodesulfurization operation is performed in a manner which increases the aliquot ratio of distillate to residual components in the oil, thereby improving hydrogen economy in the hydrodesulfurization operation and at the same time producing a hydrodesulfurized residual oil in which an enhanced quantity of residual (1050° F.+) (566° C.+) components per barrel of cracker feedstock can be flash vaporized at the inlet of the catalytic riser.

When residual oils, such as petroleum residuals, are desulfurized in the presence of molecular hydrogen, the hydrogen consumption economy of the desulfurization reaction decreases as the depth of sulfur removal increases. For example, in the catalytic hydrodesulfurization of a 650° F.+(343° C+) Kuwait reduced crude oil containing 4 weight percent suffur, it was found that removal of 3 of the 4 weight percent sulfur present in the oil to reduce the sulfur content of the oil to 1 weight percent requires a hydrogen consumption of about 500 standard cubic feet per barrel (9 SCM/100 L), providing a hydrogen efficiency of 167 standard cubic feet of hydrogen (4.68 $M^3$) per percent of sulfur in the oil which is removed. The removal of the next 0.7 weight percent increment to reduce the sulfur content of the oil to 0.3 weight percent requires a hydrogen consumption of 165 standard cubic feet per barrel (2.97 SCM/100 L), providing a hydrogen efficiency of 236 standard cubic feet of hydrogen (6.61 $M^3$) per percent of sulfur in the oil which is removed. Finally, the removal of an additional 0.2 weight percent sulfur increment to reduce the sulfur content of the oil to 0.1 weight percent requires a hydrogen consumption of 170 standard cubic feet per barrel (3.07 SCM/100 L), providing a hydrogen efficiency of 850 standard cubic feet of hydrogen (23.8 $M^3$) per percent of sulfur in the oil which is removed. These data show that with removal of progressively deeper increments of sulfur from the residual oil the hydrodesulfurization process becomes progressively hydrogen inefficient as evidenced by the fact that removal of the final 0.2 weight percent increment of sulfur in the oil requires about 5 times the hydrogen consumption per atom of sulfur removed as compared to the hydrogen consumption during the removal of the first 3 weight percent increment of sulfur in the oil.

The present process employs a method for the multistage desulfurization of residual oil which provides a desulfurized product having a relatively low sulfur level while avoiding deep, hydrogen-inefficient hydrodesulfurization of the heavy portion of the residual oil. The present process employs a series multi-stage hydrodesulfurization operation including removal of a portion of a concentrated high boiling residual oil stream between upstream and downstream stages. At the same time, a concentrated distillate fraction is charged to the downstream stage independently of the residual fraction. Thereby, the stream entering the downstream stage contains a non-aliquot proportion of distillate and residual components since it is impoverished or depleted of residual components although it contains most or all of the distillate components of the feed oil to the hydrodesulfurization process. Since the sulfur in the distillate oil is relatively non-refractory, the dilution of residual components with distillate oil relieves the second stage of the necessity of accomplishing extremely deep desulfurization of refractory residual components in order to produce a low sulfur effluent stream.

One method of obtaining a non-aliquot distillate-residual oil hydrodesulfurization stream which is relatively enriched in distillate components is to distill a crude or reduced crude feed oil containing substantially all of the asphaltenes of the full crude to prepare separate distillate and residual oil fractions for hydrodesulfurization. According to this method, the residual fraction is passed to a first or upstream hydrodesulfurization stage while the distillate fraction by-passes the upstream stage and is passed directly to a second or downstream stage. A portion of the residual oil fraction is removed between the stages, and the greater the amount of distillate oil removed at the feed distillation column the more concentrated in residual components will be the oil removed between the stages and the greater will be the dilution of the non-removed residual components when blended with the distillate fraction in the downstream stage. An amount between about 10, 20, or 30 up to 50, 65, or 75 weight percent of essentially the full range normally liquid material in the stream flowing between the stages is removed from the process.

Another method for increasing the aliquot ratio of distillate to residual components of the oil during the hydrodesulfurization operation provides a diminished distillation energy consumption and utilizes the exothermic heat of the hydrodesulfurization reaction in the first or upstream stage to accomplish at least part of the separation of distillate from residual oil. According to this method, the hot effluent from the first hydrodesulfurization stage is passed to a separation chamber to flash a distillate fraction from residual material. For example, the chamber can conveniently produce a 375° to 650° F. (191° to 343° C.) overhead distillate fraction using the exothermic heat generated in the first hydrodesulfurization stage. The amount of distillate produced at the interstage flash can be increased by adding heat to the interstage flash chamber which is obtained from a source other than the upstream hydrodesulfurization stage. If desired, a vacuum can be applied to the interstage chamber to enhance distillate production. In this manner, a distillate fraction of any suitable boiling range can be taken overhead from the interstage flashing step. A segment of the flash residue is removed from the process and the interstage distillate fraction is passed to the second or downstream stage together with the remaining portion of the flash residue. An amount ranging between about 10, 20 or 30 up to 50, 65 or 75 weight percent of the flash residue is removed from the process. In this manner, the exothermic heat of the first stage hydrodesulfurization reaction is utilized to at least partially separate distillate from residual components so that a portion of the concentrated residual oil stream can be removed from the process and a non-aliquot distillate-residual oil second stage stream can be prepared which is relatively enriched in distillate components. If desired, the second stage stream can be further enriched in distillate components by the addition thereto of an extraneous distillate stream.

The present invention is illustrated in the accompanying figures in which

Figure 2:
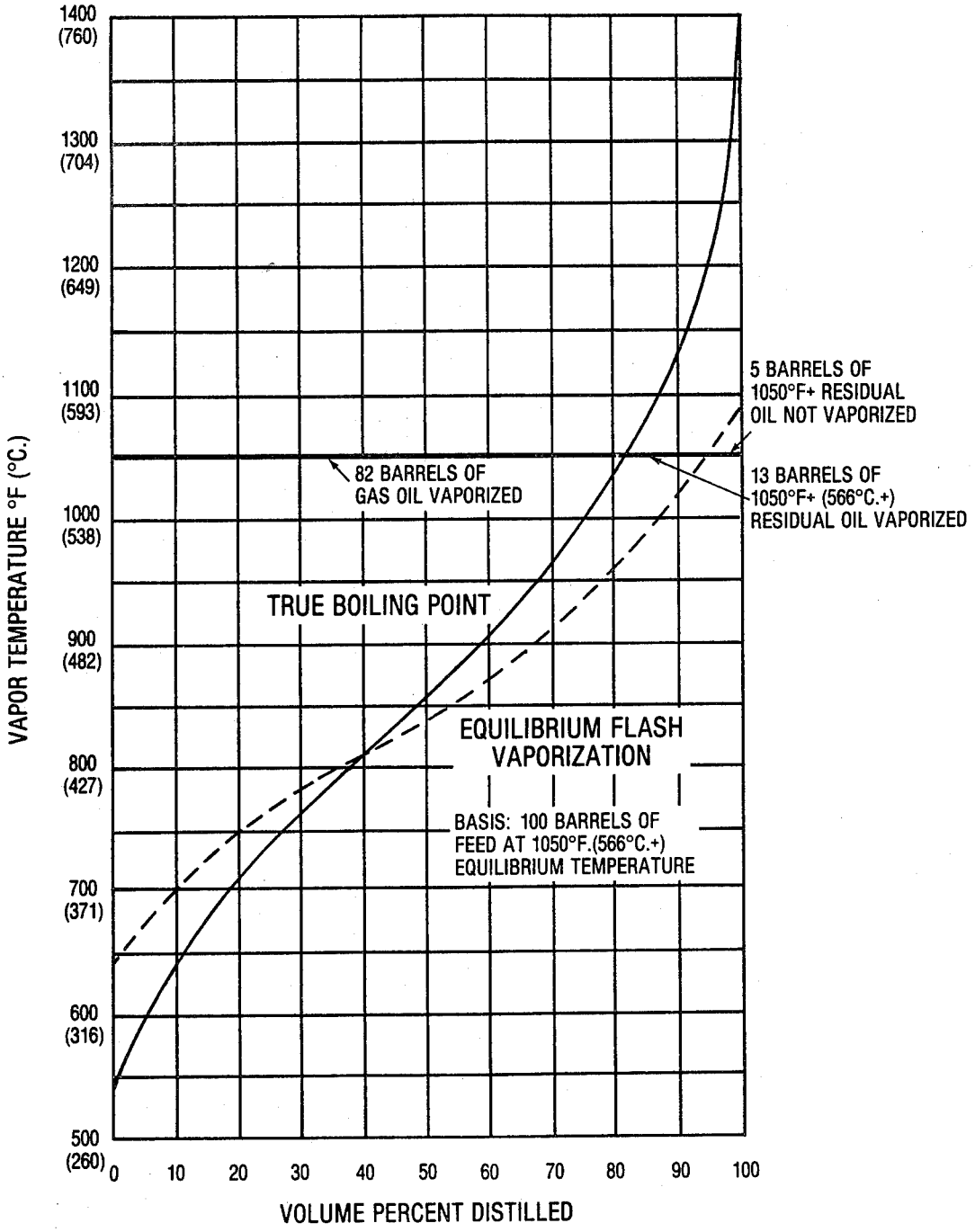
Figure 3:
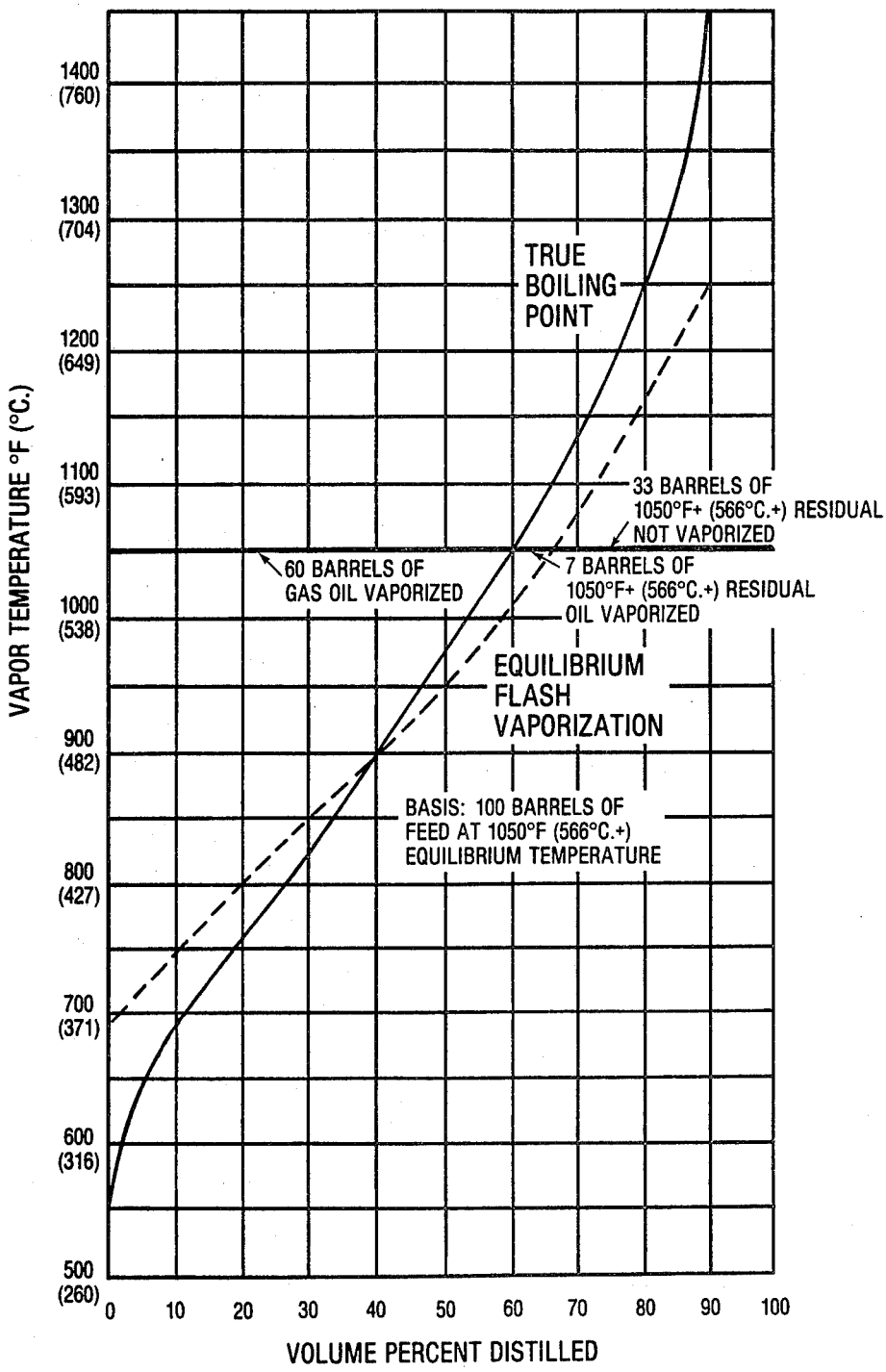
Figure 4:
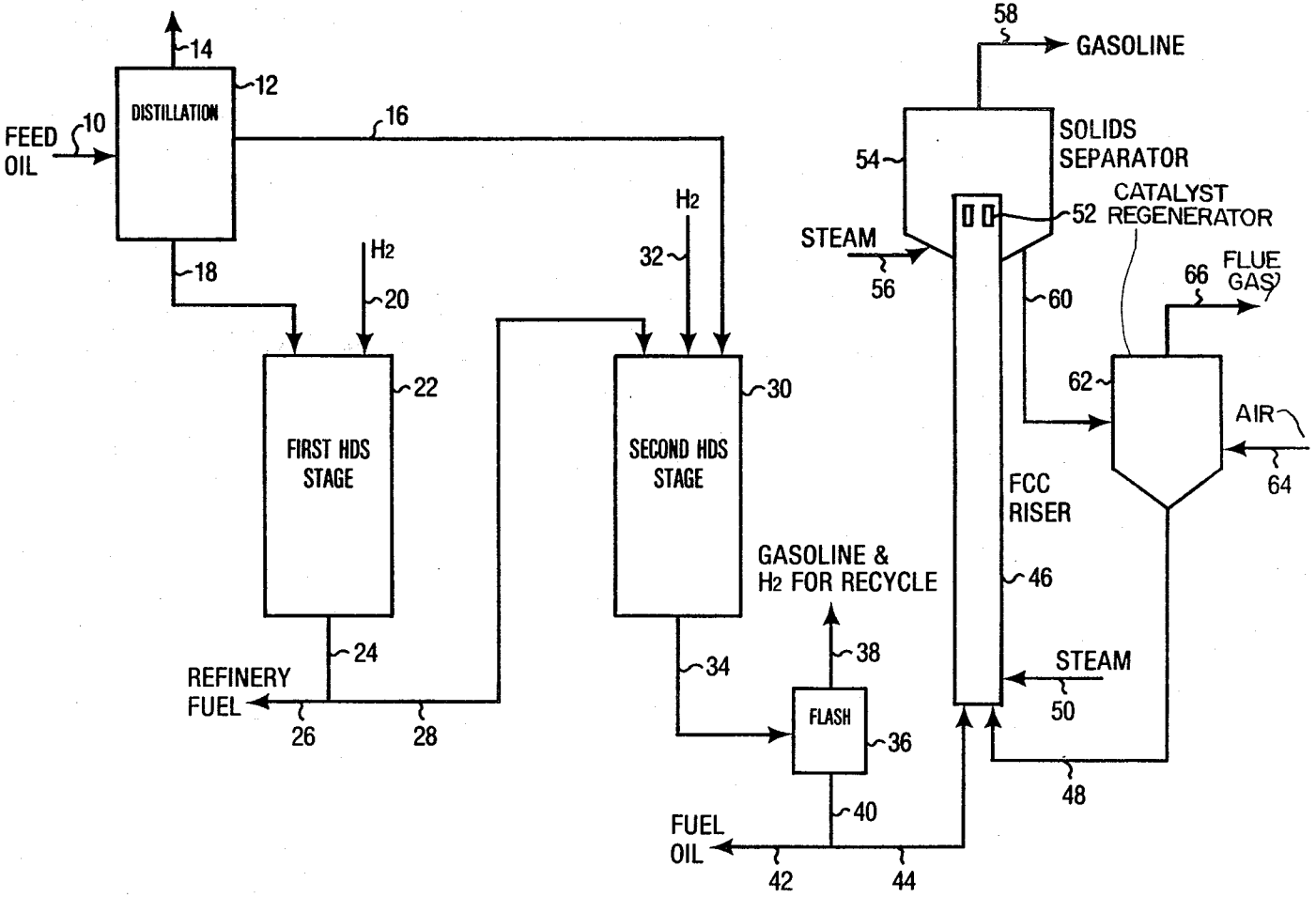
Figure 5:
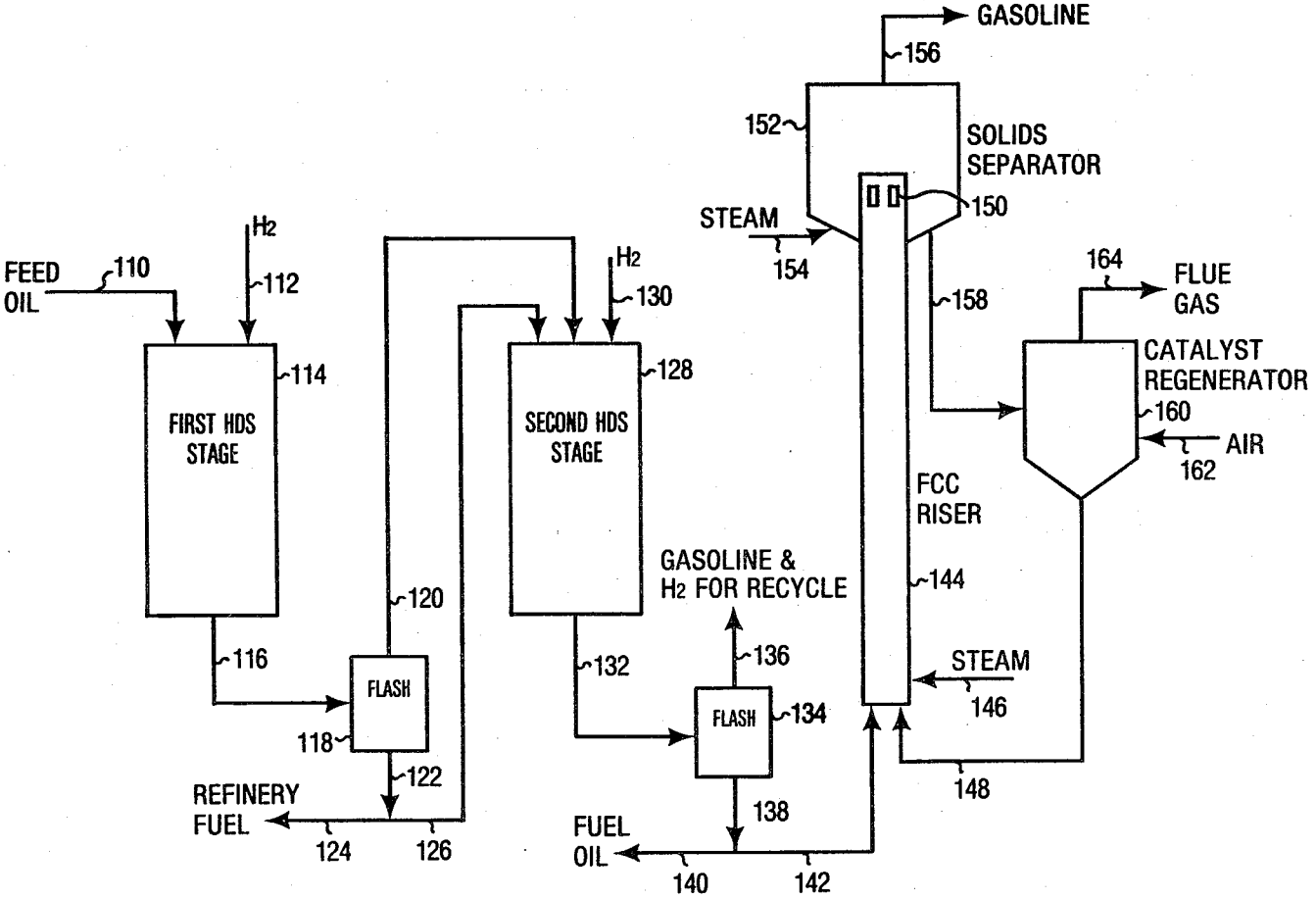

FIG. 1 contains graphs illustrating the component distribution in a residual oil hydrodesulfurization process, FIGS. 2 and 3 contain graphs illustrating the flash vaporization characteristics of a residual oil in a cracking riser, FIG. 4 shows one process scheme for performing the process of this invention, and FIG. 5 shows another process scheme for performing the process of this invention.

The decrease in hydrodesulfurization duty resulting from an increase in the aliquot ratio of distillate to residue components in the stream being treated is illustrated by the data of Table 1. Table 1 shows the volume percent of various boiling range fractions and the sulfur content of each fraction in a hydrodesulfurization effluent stream containing 0.15 weight percent sulfur obtained by hydrodesulfurization of a 650° F.+(343° C.+) Kuwait residual oil containing 4 weight percent sulfur.

TABLE 1

| TBP FRACTION | VOL. % OF TOTAL YIELD | WT. % SULFUR IN FRACTION | % OF TOTAL SULFUR IN PRODUCT |
|---|---|---|---|
| IBP-375° F. (IBP-191° C.) | 1.62 | 0.04 | 0.38 |
| 375-650° F. (191-343° C.) | 13.71 | 0.04 | 3.50 |
| 650-1065° F. (343-574° C.) | 68.11 | 0.09 | 40.84 |
| 1,065° F. + (574° C.+) | 16.56 | 0.47 | 55.28 |

Table 1 shows that more than half of the total sulfur in the product is contained in the highest boiling 16.56 volume percent fraction of the total yield, which is the 1065° F.+(574° C.+) fraction. Therefore, if half of the 1065° F.+(574° C.+) product fraction could be utilized as refinery fuel, removal of this segment would constitute removal of only about 8 volume percent of the stream but would accomplish removal of about 28 weight percent of the total sulfur in the stream. It is seen that removal of a relatively small volumetric portion of the total stream, when the removed portion is a concentrated residue fraction, substantially diminishes the sulfur concentration in a remaining non-aliquot distillate-residue stream. This method thereby greatly reduces the depth of hydrodesulfurization required to produce an ultimate product having a low sulfur level. In this manner, a product having a low sulfur level can be produced with a relatively high hydrogen efficiency.

The data of Table 1 indicate that the most refractory sulfur in a residual oil is concentrated in the highest boiling fraction, which is the asphaltene-containing fraction. Asphaltenes are non-distillable. However, some of the non-distillable asphaltenes in the feed oil are upgraded to distillate material via hydrodesulfurization in the first stage, leaving the most refractory asphaltenes in the first stage effluent. This is illustrated by FIG. 1, herein, which was also presented in U.S. Pat. No. 3,761,399, and which shows the proportions of aromatics, saturates, resins and asphaltenes in a 650° F.+(343° C.+) residual oil as the oil experiences progressive catalytic hydrodesulfurization. The resins and asphaltenes comprise the residue of a propane extraction of the oil. Resins and asphaltenes are subsequently separable by a pentane extraction since resins are soluble in pentane while asphaltenes are not. As shown in FIG. 1, the resin and asphaltene content of the oil steadily decreases with increasing hydrodesulfurization. This decrease is due to the severing of carbon-sulfur bonds, thereby breaking off molecular fragments. The accumulation of these molecular fragments is reflected in FIG. 1 by the indicated build-up of lower molecular weight saturates and aromatics. When the desulfurization level reaches about 75 percent, the resin and asphaltene content of the oil beomces stable, indicating little additional severing of molecular fragments therein. At the same time, the total aromatics and saturates content also tends to stabilize, with any increase in saturates level being accompanied by a decrease in aromatics level. This indicates that after about 75 percent desulfurization the process tends to consume hydrogen by hydrogenation of aromatics, which represents a fruitless consumption of hydrogen.

It has been observed in conventional residual oil hydrodesulfurization processes which produce a very low sulfur residual oil product, requiring more than about 90 or 95 weight percent desulfurization, the unconverted asphaltenic material in the product becomes highly incompatible with the lower boiling oils and tend to settle out of solution. This incompatibility may arise because the hydrogen consumed during deep desulfurization is selectively acquired by the lower boiling oils, as indicated by the increase in saturates level in FIG. 1, while refractory asphaltenes are impervious to hydrogenation, thereby inducing a widened differential in the hydrogen to carbon ratios of the unconverted asphaltenes and the hydrogenated oils. The removal of a portion of a concentrated stream of asphaltenes from the process reduces the level of hydrogenation required to produce a low sulfur product so that the stability of the refractory asphaltenes remaining in the hydrodesulfurized oil tends to be improved.

FIG. 1 shows that a substantial portion of the feed asphaltenes (the general term "asphaltenes" as used herein includes both asphaltenes and resins, since both are non-distillable materials) can be converted to saturates and aromatics in an upstream hydrodesulfurization stage. The demonstration in FIG. 1 that a substantial portion of the feed asphaltenes can be converted in an upstream hydrodesulfurization stage is the reason that a portion of the asphaltenes is not removed directly from the feed oil in the hydrodesulfurization operation. By removing asphaltenes from an upstream stage effluent stream rather than directly from the feed oil, the asphaltene removal is selective towards refractory asphaltenes. The demonstration in FIG. 1 that an attempt to convert the refractory asphaltenes is extremely difficult and results in a wasteful consumption of hydrogen, as evidenced by a conversion of aromatics to saturates, is the reason that a portion of the refractory asphaltenes is removed in advance of the downstream stage.

Data were also presented in U.S. Pat. No. 3,761,399 showing that in a non-desulfurized residual oil the sulfur concentration in the various fractions are relatively uniform and that it is in the course of the hydrodesulfurization operation that the highest sulfur concentration devolves to the high boiling refractory asphaltene fraction. Table 2 shows the progressive changes in sulfur concentration occuring in various fractions during two stage catalytic hydrodesulfurization of a reduced crude oil containing 4.09 weight percent sulfur. The 650° F.+(343° C.+) product of the first stage had a sulfur content of 1.09 weight percent while the corresponding second stage effluent oil contained 0.58 weight percent sulfur.

TABLE 2

| | Feed to first stage (4.09 wt. % sulfur) | | Feed to second stage (1.09 wt. % sulfur) | | Product from second stage (0.58 wt. % sulfur) | |
|---|---|---|---|---|---|---|
| | Fraction | Sulfur in Fraction | Fraction | Sulfur in Fraction | Fraction | Sulfur in Fraction |
| Percent by wt.: | | | | | | |
| Saturates | 17.98 | 3.42 | 22.24 | 0.80 | 22.34 | 0.49 |
| Aromatics | 55.45 | 5.04 | 60.45 | 1.12 | 61.91 | 0.56 |
| Resins | 16.73 | 5.59 | 13.76 | 2.37 | 12.72 | 1.56 |
| Asphaltenes | 9.84 | 6.99 | 3.55 | 4.95 | 3.03 | 3.13 |

Table 2 shows that the sulfur levels in the various fractions of the feed oil are relatively uniform. However, during passage of the feed oil through the first hydrodesulfurization stage the saturates and aromatics lose sulfur to the greatest extent, while the resins and asphaltenes lose sulfur to the least extent. The same occurs during second stage hydrodesulfurization.

Table 3 contains data from U.S. Pat. No. 3,761,399 which show the effect of catalytic hydrodesulfurization upon the boiling range of a residual oil. In the tests of Table 3, the reduced crude was hydrodesulfurized in three stages.

TABLE 3

| | Feedstock | Effluent from each of three desulfurization stages | | |
|---|---|---|---|---|
| Sulfur, percent by wt. | 5.43 | 4.77 | 1.41 | 0.83 |
| Boiling range, °F. | 566–1,400+ (297–560° C.+) | 514–1,400+ 269–560° C.+) | 509–1,400+ (265–560° C.+) | 466–1,400+ (241–560° C.+) |
| Desulfurization, percent | — | 12.2 | 74.0 | 85.0 |

The data of Table 3 show that while the first 74 percent of the sulfur in the oil was being removed, the IBP of the oil was reduced from 566° to 509° F. (297° to 265° C.), or 57° F. (32° C.), while the attempt to reduce the sulfur content only slightly further to achieve 85 percent desulfurization induced reduction of the IBP to 466° F. (241° C.), or an additional 43° F. (24° C.). These data show that the first 74 percent desulfurization has a relatively small effect upon the boiling point reduction, while the removal of the more refractory sulfur has a greater effect upon boiling point reduction. It is a significant feature of the present invention that since desulfurization is achieved in part by a dilution effect in place of deep hydrodesulfurization, the process of the present invention can diminish even the small amount of boiling point reduction shown in the above table, thereby reducing hydrogen consumption. Any reduction in hydrocracking in the hydrodesulfurization operation is particularly significant in the present invention because the hydrodesulfurization effluent is subsequently catalytically cracked in the absence of added hydrogen. Any boiling point reduction in the hydrodesulfurization operation incurs the expense of hydrogen consumption, whereas the same can be achieved in the subsequent cracking step without incurring the expense of hydrogen consumption.

The catalyst of the first stage of a multi-stage residual oil hydrodesulfurization system is not greatly deactivated by coking because relatively reactive asphaltenes are available for conversion in the first stage. In multistage oil hydrodesulfurization processes, most of the sulfur is removed in the first stage. For example, the first stage generally removes 60, 70, 75 or more weight percent of the sulfur content in the feed oil. However, the more refractory asphaltenes pass unconverted through the first stage and it is the sulfur in these refractory asphaltenes that conventionally must be removed in second or third hydrodesulfurization stages. Unfortunately, refractory asphaltenes are known coke formers and the removal of sulfur therefrom in a downstream stage is conducive to coke formation. Therefore, in conventional multistage hydrodesulfurization operations, while coke formation is not significant in the first stage, the second stage catalyst is generally deactivated by coke, and the deactivation of the second stage catalyst generally occurs more rapidly than the deactivation of the first stage catalyst. The coke problem in a second or third stage is the reason for the use of a specialized coke-resistant catalyst in downstream stages, such as the Group IV-B metal-promoted coke resistant second stage catalyst utilized in the process of U.S. Pat. No. 3,968,027.

The amount of coking in a second or subsequent hydrodesulfurization stage generally increases with the concentration of refractory asphaltenes in the coil steam flowing through those stages. Downstream hydrodesulfurization catalysts tend to induce coking via agglomeration and polymerization of refractory asphaltene molecules. These reactions occur because desulfurization catalysts are hydrogenation-dehydrogenation agents and since the asphaltenes in the downsteam stages are refractory to hydrodesulfurization their residence time at the surface of the catalyst is extended, blocking access of hydrogen to the catalyst, and it is this inaccessibility of hydrogen which induces dehydrogenation and ultimately coking. Any increase in the concentration of refractory asphaltenes tends to increase the incidence of agglomeration and polymerization and, conversely, the amount of coking in the second stage is reduced via removal of a portion of the refractory asphaltenes between the stages and by dilution of the non-removed asphaltenes prior to their entry into the second stage. The removal of a segment of the concentrated asphaltene stream flowing from the first stage in accordance with the hydrodesulfurization operation of this invention constitutes selective removal of the most refractory molecules in the system. Dilution of the non-removed asphaltenes with non-desulfurized or partially desulfurized distillate oil shifts the desulfurization duty of the catalyst in second and subsequent stages from the refractory heteroatom sulfur embedded within polycondensed aromatic rings of asphaltenic molecules to the more reactive thiophenic sulfur in distillate molecules.

The stream flowing through the second stage comprises a non-aliquot ratio of distillate to residual components since it contains most or all of the distillate components of the feed steam but has been deprived of a portion of the asphaltene components. The diminished quantity of refractory asphaltenes entering the second stage will have the benefit of the dilution and viscosity reducing effects of most or all of the distillate portion of the feed oil. It was known in U.S. Pat. No. 3,761,399 that the rate of hydrodesulfurization of a residual fraction can be improved by diluting the residual fraction with highly desulfurized gas oil, probably due to solubilizing of viscous, high molecular weight sulfur-containing molecules and improving their mass transfer in the system. That patent further showed that excessive dilution of a residual fraction with highly desulfurized gas oil can inhibit the rate of desulfurization of the residual fraction probably due to excessive dispersal of the sulfur-containing molecules. However, the present hydrodesulfurization operation tends to circumvent the problem of a diminished rate of second stage residual oil desulfurization. The present operation permits a relaxation of dependence upon deep desulfurization of the residual fraction by practicing the interdependent operations of selective removal from the process of a concentrated stream of sulfur-refractory residual components and dilution of the non-removed residual components with the distillate portion of the feed oil, so that the oil flowing through the downstream stage comprises a non-aliquot mixture of residual and distillate components, as compared to the feed oil. In this manner, in a downsteam stage the quantity of the most sulfur-refractory material in the feed oil is diminished concomitantly with an increase in the concentration of the most sulfur-reactive material in the feed, releasing the process from the burden of accomplishing deep desulfurization of residual components in order to achieve a low sulfur product.

Since the refractory asphaltenes removed between the stages in the material which would have contributed most heavily to coking in the downstream stage, the total liquid yield of the process is enhanced by avoiding conversion of liquid material to coke. This advantageous yield effect provides a concomitant advantageous catalyst aging effect since diminution of coke formation in the downstream stage tends to extend the active life of the second stage catalyst.

The described hydrodesulfurization operations involve plural stage hydrodesulfurization of an asphaltene-containing residual oil in which at least two different streams of hydrodesulfurized residual oil are removed from the process with each removed stream having a different sulfur content and boiling range as it is separated from the process, without any product blending of product distillation step being required to accomplish these differences. One of the product residual oil streams has a narrow boiling range and a relatively high sulfur level while the other product residual oil stream has a wider boiling range and a relatively low sulfur level. The low sulfur residual oil stream comprises the feedstock for the catalytic cracking operation. The relatively high sulfur level residual oil product has a higher average boiling point and meets the less demanding specifications for refinery fuels. In addition to advantageously increasing the aliquot ratio of distillate to residual components in the low sulfur product, removal of a refinery fuel stream in the hydrodesulfurization operation avoids overtreating of that portion of the total stream, relative to its intended use, resulting in a significant savings in hydrogen, in extended hydrodesulfurization catalyst life and in increased liquid yield in the hydrodesulfurization operation. The increased liquid yield results from reduced conversion to coke.

The catalyst of all of the hydrodesulfurization stages comprises at least one Group V metal and at least one Group VIII metal on a non-cracking support. Suitable Group VI and Group VIII metal combinations include cobalt-molybdenum, nickel-tungsten and nickel-molybdenum. A preferred combination is nickel-cobalt-molybdenum. The catalyst support comprises a highly porous, non-cracking supporting material. Alumina is the preferred supporting material, but other porous, non-cracking supports can be employed, such as silica alumina and silica-magnesia.

The catalyst in any downstream hydrodesulfurization stage can be the same as or different from the catalyst employed in the first stage. For example, the proportions of catalytic metals can be the same or can be different. The composition of the downstream catalyst can be generally the same as the composition of the first stage catalyst except that it contains a promoting amount of Group IV-G metal, such as titanium, zirconium or hafnium, preferably titanium. Promotion with a Group IV-G metal improves the resistance of the downstream catalyst to coking. However, removal of a portion of the refractory asphaltene stream in advance of the downstream stage as indicated diminishes the need for coke-resistant downstream catalyst.

In the hydrodesulfurization operation, the oil is passed downwardly through a fixed bed of catalyst in each stage. Very little hydrocracking occurs in the hydrodesulfurization operation. In general, at least 40 or 50 weight percent of the total hydrodesulfurization product boils above the IBP of the hydrodesulfurization feed oil and, preferably, at least 70, 80 or 90 weight percent of the hydrodesulfurization product boils above the IBP of the hydrodesulfurization feed oil. The hydrodesulfurization temperature should be sufficiently low that not more than 30 percent, generally, and preferably not more than about 20, 15 or 10 percent of the 650° F.+ (343° C.+) feed oil will be converted to material boiling below 650° F. (343° C.).

The hydrodesulfurization operation employs in each stage a hydrogen partial pressure of 500 to 5,000 pounds per square inch (35 to 350 kg/cm$^2$), generally 1,000 to 3,000 pounds per square inch (70 to 210 kg/cm$^2$), preferably, and 1,500 to 3,000 pounds per square inch (105 to 175 kg/cm$^2$), most preferably. The gas circulation rate in each stage can be between 1,000 and 20,000 standard cubic feet per barrel (17.8 and 356 SCM/100 L), generally, or preferably about 2,000 to 10,000 standard cubic feet per barrel (35.6 to 178 SCM/100 L). The gas circulated preferably contains 85 percent, or more, of hydrogen. The mol ratio of hydrogen to oil in each stage can be between about 4:1 and 80:1. Reactor temperatures can vary between about 600° and 900° F. (316° and 482° C.), generally, and between about 650° and 800° F. (343° and 427° C.), preferably. Reactor temperatures are increased in each stage during a catalyst cycle to compensate for activity loss due to aging. The liquid hourly space velocity in each reactor can be between about 0.1 and 10, generally, and between about 0.2 and 1 or 2, preferably.

The present process can be used for hydrodesulfurizing and catalytically cracking asphaltene-containing oils other than petroleum oils, such as coal liquids and oils extracted from shale and tar sands. Asphaltenes have a relatively low hydrogen to carbon ratio and will generally comprise less than half of the feed oil, but will generally contain most of the metallic components present in the total feed, such as nickel and vanadium.

The primary product of the above-described hydrodesulfurization operations may or may not be passed through one or more additional hydrodesulfurization stages before it is employed as a feedstock for a fluid catalytic cracking (FCC) process employing a zeolite catalyst. The primary hydrodesulfurization product contains residual components and these residual components must be vaporized at the bottom of the cracking riser because only by vaporization can feed components be cracked to gasoline and other liquid products. Residual feed components that do not vaporize at the riser inlet deposit upon the hot surface of the regenerated zeolite catalyst and are converted to coke, thereby resulting in a loss of liquid and gaseous product and a lowering of catalyst activity. This deleterious effect occurs in addition to the deposition upon the catalyst of the metals content of the residual oil, especially nickel and vanadium, further tending to reduce catalyst activity and selectivity.

Vaporization of high boiling residual feed components occurs at the riser inlet, which is the hottest region of the riser. At the riser inlet, the hot, regenerated catalyst and preheated feed, generally together with a mixing agent such as steam, nitrogen, methane, ethane or other light gas, are intimately admixed to achieve an equilibrium temperature nearly instantaneously. This equilibrium temperature is referred to herein as the equilibrium flash vaporization temperature of the feed because it is in the process of achieving this temperature that all the feed components that are to vaporize do vaporize. At this equilibrium temperature substantially complete heat exchange between all materials fed to the riser is achieved.

It is desirable for the equilibrium flash vaporization temperature at the bottom of the FCC riser to be as high as possible in order to vaporize as much of the feed oil as possible. It is best to achieve this high equilibrium temperature by utilizing a high catalyst regenerator temperature. However, the regenerator temperature is limited by many factors inherent in the system such as susceptibility of the catalyst to sintering and deactivation, equipment metallurgical temperature limitations, the amount of carbon on the deactivated catalyst, etc. A much less desirable method of increasing the equilibrium temperature is by arbitrary increase of catalyst feed rate because high catalyst-to-oil ratios are known to reduce the selectivity to gasoline product in an FCC process by increasing production of undesirable products.

Since the equilibrium flash vaporization temperature is essentially fixed by the regenerator temperature, the oil feed rate, the oil preheat temperature and the catalyst-to-oil ratio, in accordance with the present invention the quantity of residual oil which is vaporized at a given equilibrium temperature is established by adjusting the proportion of residual to distillate material in the feed, and this adjustment can be made by varying the amount of refinery fuel removed from the process between hydrodesulfurization stages. It is shown below that the removal of concentrated residual oil as refinery fuel during the hydrodesulfurization operation as described above can increase the amount of residual components in each barrel of feedstock which is vaporized at the bottom of the FCC riser.

The criticality to the FCC operation of variations in the 1050° F.+ (566° C.+) residue content in the hydrodesulfurized hydrocarbon feed to the FCC process will be appreciated by comparing the data of FIGS. 2 and 3. The volume percent of two different residual oils that can be vaporized at various temperatures in shown in FIGS. 2 and 3, respectively, which were presented in U.S. Pat. No. 3,785,959. The solid curve of both FIGS. 2 and 3 represent the true boiling point characteristics of the respective feed oils while the dashed curves represent equilibrium flash vaporization characteristics of the respective feed oils. As shown in FIGS. 2 and 3, there is a substantial difference in the 1050° F.+ (566° F.+) content of the residual oil tested in each figure; the oil tested in FIG. 2 having 18 volume percent of residual components boiling above 1050° F. (566° C.) and the oil tested in FIG. 3 having 40 volume percent of residual components boiling above 1050° F. (566° C.). However, FIGS. 2 and 3 show that the amount of 1050° F.+ (566° C.+) residual components actually vaporized in an FCC riser is determined by the equilibrium flash vaporization temperature rather than the true boiling point characteristics of the oil, because flash vaporization involves entrainment of materials boiling above the equilibrium temperature.

Assuming the equilibrium temperature at the bottom of the FCC riser is fixed at 1050° F. (566° C.) by process conditions, then FIG. 2 shows that the oil at the bottom of the riser on a 100 barrel basis will comprise 82 barrels of vaporized gas oil having a true boiling point below 1050° F. (566° C.), 13 barrels of vaporized 1050° F+ (566° C.+) true boiling point residue and only 5 barrels of unvaporized residue having a true boiling point above 1050° F. (566° C.). Thereby, 13 of the 18 barrels of 1050° F.+ (566° C.+) components per 100 barrels of feed oil are vaporized by entrainment.

The oil employed in the tests of FIG. 3 contains a much greater proportion of 1050° F.+ (566° C.+) components than the oil employed in the tests of FIG. 2. As shown in FIG. 3, at a 1050° F. (566° C.) equilibrium temperature, on a 100 barrel basis, the vapor produced at an equilibrium flash vaporization temperature of 1050° F. (566° C.) comprises 60 barrels of gas oil vapor having a true boiling point below 1050° F. (566° C.), and only 7 barrels of entrained residual oil vapor having a true boiling point above 1050° F. (566° C.), while 33 barrels of residue having a true boiling point above 1050° F. (566° C.) remain unvaporized. The feed stock of FIG. 3 is unsuitable for use as a feedstock to an FCC riser having a 1050° F. (566° C.) flash equilibrium temperature because for an oil to be a suitable FCC feedstock it is necessary that less than 10 percent remain unvaporized at the bottom of the riser. The very important comparison is made between the feed oil of FIG. 2 and the feed oil of FIG. 3 that there is considerably less 1050° F.+ (566° C.+) residue vaporized per barrel of feed oil at the same equilibrium temperature in the case of the feed oil of FIG. 3 than in the case of the feed oil of FIG. 2, even though the feed oil of FIG. 3 contains a considerably higher proportion of 1050° F.+ (566° C.+) residue than the feed oil of FIG. 2. FIG. 3 shows that when the quantity of 1050° F.+ (566° C.+) residue per barrel of feed is high, the amount of 1050° F.+ (566° C.+) residue that can be vaporized is low. The reason, as indicated above, is that equilibrium flash vaporization is a phenomenon in which residual molecules are vaporized by entrainment with low boiling material and as the proportion of low boiling material increases the quantity of entrained residual molecules can increase. Therefore, the hydrodesulfurization operation of the present invention functions interdependently with respect to the subsequent FCC operation by increasing the aliquot proportion of distillate components in the FCC feedstock so that the amount of 1050° F.+ (566° C.+) residue per barrel of FCC feedstock that can be vaporized at the bottom of the FCC riser is increased. This is a highly important observation in accordance with the present invention because the quantity of 1050° F.+ (566° C.+) residue which is vaporized determines the percent yield of liquid and gaseous products based on feedstock in the FCC cracking operation.

In accordance with the present invention, there is a further and highly critical interdependency between the hydrodesulfurization and FCC operations due to the diminution of the aliquot proportion of asphaltenes in the oil during the hydrodesulfurization operation. Substantially all the metals in the oil are contained in the 1050° F.+ (566° C.+) fraction of the oil. Metals contained in a residual oil constitute a poison to a zeolite cracking catalyst. However, if a residual oil is demetallized during hydrodesulfurization to a nickel equivalent of less than 1, generally, or preferably less than 0.6 ppm (nickel equivalent is equal to the ppm by weight of nickel plus 1/5 the ppm by weight of vanadium which is present in the oil) the oil can be cracked in a fluid zeolitic cracking riser with a catalyst make-up rate which is no greater than is required when a distillate gas oil constitutes the entire cracking feedstock, i.e. with no more than about 0.2 pounds of make-up zeolite catalyst per barrel of feed (571 g/$M^3$). It is ordinarily difficult during hydrodesulfurization to reduce the nickel equivalent of a residual oil to a level as low as 1, or 0.6. In accordance with this invention, the nickel equivalent in the desulfurized oil can be regulated by the amount of partially desulfurized 1050° F.+ (566° C.+) oil removed from the first stage effluent stream and removed from the hydrodesulfurization operation. The interstage removal of concentrated asphaltenes in the hydrodesulfurization operation therefore functions interdependently with respect to the FCC operation by not only increasing the amount of asphaltenes vaporized in the FCC riser but also by removing a concentrated source of metal poisons from the FCC feedstock.

The FCC riser reaction conditions include a temperature of at least 900° F. (482° C.). The upper temperature limit can be about 1,100° F. (593° C.), or more. The reaction total pressure can vary widely and be, for example, 5 to 50 psig (0.35 to 3.5 kg/$cm^2$), or, preferably, 20 to 30 psig (1.4 to 2.1 kg/$cm^2$). The maximum residence time is 5 seconds, and for most charge stocks the residence time will be as high as 1.5 or 2.5 seconds, or, less commonly, 3 or 4 seconds. The amount of diluent, such as steam, can vary. A typical amount is about 10 percent by volume, which is about 1 percent by weight. A suitable but non-limiting proportion of diluent gas, such as steam or nitrogen, to fresh hydrocarbon feed can be 0.5 to 10 percent by weight.

A suitable weight ratio of zeolite catalyst to riser feed oil is about 4:1 to about 12:1 or 15:1 or even 25:1, generally, or 6:1 to 10:1, preferably. Generally, catalyst regeneration can occur at a temperature of 1,240° F. or 1,250° F. (671° or 677° C.), or more, to reduce the level of carbon on the regenerated catalyst from about 0.6 to 1.5 to about 0.05 to 0.3 weight percent.

A process scheme for performing the present invention is presented in FIG. 4. As shown in FIG. 4, feed oil in line 10, which can be crude oil or topped crude, is passed to distillation column 12 from which a light oil fraction, such as naphtha, is removed through line 14, a middle distillate oil fraction is removed through line 16 and a residual oil fraction is removed through line 18. The middle distillate in line 16 can comprise a 375° to 650° F. (191° to 343° C.) boiling range fraction, a 375° to 800° F. (191° to 427° C.) boiling range fraction, a 650° to 800° F. (343° to 427° C.) boiling range fraction, or a fraction of any other suitable boiling range. The residual oil in line 18 can have an IBP of 650° F. (343° C.), 800° F. (427° C.), or it can have any other suitable IBP. The residual oil in line 18 and hydrogen entering through line 20 are passed through first catalytic hydrodesulfurization stage 22. First stage hydrodesulfurized effluent is removed through line 24, a portion of which is removed from the process through line 26 for use as refinery fuel, while the remainder is passed through line 28 to second catalytic hydrodesulfurization reactor 30 together with hydrogen entering through line 32 and distillate oil entering through line 16, which by-passes first hydrodesulfurization stage 22.

Effluent from second hydrodesulfurization reactor 30 passes through line 34 to flash chamber 36 from which an overhead hydrogen-containing stream 38 is removed for purification and recycle and from which a flash residue is removed through line 40. The flash overhead stream will also include gaseous hydrocarbons and gasoline. If desired, a portion of the flash residue from line 40 is removed as commercial fuel oil through line 42 while the remainder is passed through line 44 to FCC riser 46 for zeolitic cracking to a product containing gasoline.

The FCC feed stream in line 44 is sufficiently low in sulfur content to satisfy sulfur dioxide environmental requirements for the regenerator flue gas and is sufficiently low in metals content to satisfy nickel and vanadium specifications established for FCC distillate feedstocks. The removal of sufficient concentrated residual oil as refinery fuel through line 26 will increase the amount of 1050° F.+ (566° C.+) components per barrel of FCC feed oil that will vaporize at the flash vaporization temperature at the bottom of riser 46, as compared to the amount that would be vaporized if a residual stream 26 were not split out of the process.

Residual oil stream 44 is flash vaporized at the bottom of riser 46 in the presence of hot regenerated zeolite catalyst entering through line 48 and dispersion stream entering through line 50. An FCC effluent stream passes through riser discharge openings 52 to solids separator 54. Stripping stream is added to solids separator 54 through line 56 and an overhead gasoline-containing stream is recovered through line 58. A stream of coke-laden zeolite catalyst is recovered through line 60 for passage to catalyst regenerator 62. Air is charged through line 64 to regenerator 62 and flue gas is removed from regenerator 62 through line 66.

Another process flow scheme of the present invention is presented in FIG. 5. As shown in FIG. 5, residual feed oil, such as a 375° F.+ (191° C.+) reduced crude oil, in line 110 and hydrogen in line 112 are passed to first catalytic hydrodesulfurization stage 114. First stage effluent in line 116 is passed to flash chamber 118, from which a distillate oil such as a 375° to 650° F. (191° to 343° C.) fraction is removed overhead from line 120 and from which flash residue is removed through line 122. A refinery fuel stream 124 is split out of residual oil stream 122, and the remainder of the flash residue is passed through line 126 to second catalytic hydrodesulfurization stage 128.

The distillate oil in line 120, the residual oil in line 126 and hydrogen in line 130 are all passed to second catalytic reactor 128. An effluent stream is recovered from reactor 128 through line 132 and passed to flash chamber 134 for separation of an impure hydrogen stream, which is removed through line 136 for purification and recycle, from a flash residue which is discharged through line 138. The flash overhead stream will also include gaseous hydrocarbons and gasoline. A stream of commercial fuel oil in line 140 is separated from the flash residue, if desired, and the remainder of the flash residue is passed through line 142 to FCC riser 144.

The FCC feed stream in line 142 is sufficiently low in sulfur content to satisfy sulfur dioxide environmental requirements for the regenerator flue gas and is sufficiently low in metals content to satisfy nickel and vanadium specifications established for distillate oil FCC feedstocks. The removal of sufficient residual oil as refinery fuel through line 124 will increase the amount of 1050° F.+ (566° C.+) components per barrel of oil that will vaporize at the flash vaporization temperature at the bottom of riser 144 as compared to the amount that would be vaporized if a residual stream 124 were not split out of the process.

Residual oil stream 142 is mixed with steam entering through line 146 and hot regenerated zeolite catalyst entering through line 148 to induce flash vaporization at the bottom of riser 144. A riser effluent stream passes through discharge openings 150 to solids separator 152 wherein, with the assistance of stripping stream entering through line 154, a gasoline-containing stream is recovered through line 156 while a coke-laden zeolite catalyst stream is passed through line 158 to catalyst regenerator 160. Air is introduced to regenerator 160 through line 162 for combustion of carbon from the zeolite catalyst. A flue gas is recovered from the regenerator through line 164.

We claim:

1. A combination process including hydrodesulfurization of an aromatics- and asphaltene-containing feed oil to produce at least two hydrodesulfurized residual oil streams having different respective 1050° F.+ hydrocarbon and sulfur contents, said process employing upstream and downstream hydrodesulfurization stages containing hydrodesulfurization catalyst comprising Group VI and Group VIII metal on a noncracking support at a temperature between 600° and 900° F. and a hydrogen pressure between 500 and 5,000 psi, followed by a catalytic cracking step at a temperature between 900° and 1,100° F. and a residence time up to 5 seconds, said process comprising fractionating said feed oil into an asphaltene-containing residual oil and a distillate oil, passing said residual oil and hydrogen through said upstream hydrodesulfurization stage and recovering an upstream stage effluent stream containing 1050° F.+ hydrocarbons including refractory sulfur asphaltenes, splitting said upstream stage effluent stream into a first effluent portion comprising between about 10 and 75 weight percent of the normally liquid material in said upstream stage effluent stream and a second effluent portion, removing said first effluent portion from said process to selectively remove refractory sulfur asphaltenes from said process and to increase the concentration of more sulfur-reactive material in said downstream stage, passing said second effluent portion and said distillate oil and hydrogen through said downstream stage, recovering a downstream stage effluent stream containing hydrodesulfurized oil including 1050° F.+ hydrocarbons, said downstream stage effluent stream containing aromatics and having a sulfur concentration which is at least 75 percent lower than the sulfur concentration of said feed oil, the removal of said first effluent portion allowing the sulfur concentration in said downstream effluent stream to be achieved with a relatively high aromatics concentration as compared to the aromatics concentration when achieving the same sulfur concentration by hydrodesulfurization without selective removal of refractory sulfur asphaltenes, passing said hydrodesulfurized oil through a zeolitic cracking riser for conversion to gasoline, the removal of said first effluent portion from said process increasing the amount of 1050° F.+ hydrocarbons per barrel of oil vaporized at the flash vaporization temperature in said cracking riser.

2. The process of claim 1 wherein said downstream stage effluent stream is passed through an additional hydrodesulfurization stage before being passed to said zeolitic riser.

3. The process of claim 1 wherein said first effluent portion comprises between about 30 and 50 weight percent of the normally liquid material in said upstream stage effluent stream.

4. The process of claim 1 wherein said first effluent portion comprises between about 20 and 65 weight percent of the normally liquid material in said upstream stage effluent stream.

5. The process of claim 1 wherein in said upstream and downstream hydrodesulfurization stages not more than 30 percent of said feed oil boiling above 650° F. is converted to material boiling below 650° F.

6. The process of claim 1 wherein in said upstream and downstream hydrodesulfurization stages not more than 10 percent of said feed oil boiling above 650° F. is converted to material boiling below 650° F.

7. The process of claim 1 wherein in the hydrodesulfurized oil passed to the cracking riser the ppm by weight of nickel plus 1/5 the ppm by weight of vanadium is less than 1.

8. The process of claim 1 wherein the catalyst in the downstream hydrodesulfurization stage contains a promoting amount of Group IV-B metal.

9. A combination process including hydrodesulfurization of an aromatics- and asphaltene-containing feed oil to produce at least two hydrodesulfurized residual oil streams having different respective 1050° F.+ hydrocarbon and sulfur contents, said process employing upstream and downstream hydrodesulfurization stages containing hydrodesulfurization catalyst comprising Group VI and Group VIII metal on a noncracking support at a temperature between 600° and 900° F. and a hydrogen pressure between 500 and 5,000 psi, followed by a catalytic cracking step at a temperature between 900° and 1,100° F. and a residence time up to 5 seconds, said process comprising passing said feed oil and hydrogen through said upstream hydrodesulfurization stage and recovering an upstream stage effluent stream containing 1050° F.+ hydrocarbons including refractory sulfur asphaltenes, passing said upstream stage effluent stream through a flash zone to separate a flash distillate stream from a flash residue stream, splitting said flash residue stream into a first flash residue portion comprising between about 10 and 75 weight percent of said flash residue stream and a second flash residue portion, removing said first flash residue portion from said process to selectively remove refractory sulfur asphaltenes from said process and to increase the concentration of more sulfur-reactive material in said downstream stage, passing said second flash residue portion and said flash distillate stream and hydrogen to said downstream stage, recovering a downstream stage effluent stream containing hydrodesulfurized oil including 1050° F.+ hydrocarbons, said downstream stage effluent stream containing aromatics and having a sulfur concentration which is at least 75 percent lower than the sulfur concentration of said feed oil, the removal of said first flash residue portion allowing the sulfur concentration in said downstream stage effluent stream to be achieved with a relatively high aromatics concentration as compared to the aromatics concentration when achieving the same sulfur concentration by hydrodesulfurization without selective removal of refractory sulfur asphaltenes, passing said hydrodesulfurized oil through a zeolitic cracking riser for conversion to gasoline, the removal of said flash residue portion from said process increasing the amount of 1050° F.+ hydrocarbons per barrel of oil vaporized at the flash vaporization temperature in said cracking riser.

10. The process of claim 9 wherein said downstream stage effluent stream is passed through an additional hydrodesulfurization stage before being passed to said cracking riser.

11. The process of claim 9 wherein said first flash residue portion comprises between about 30 and 50 weight percent of said flash residue.

12. The process of claim 9 wherein said first flash residue portion comprises between about 20 and 65 weight percent of said flash residue.

13. The process of claim 9 wherein in said upstream and downstream hydrodesulfurization stages not more than 30 percent of said feed oil boiling above 650° F. is converted to material boiling below 650° F.

14. The process of claim 9 wherein in said upstream and downstream hydrodesulfurization stages not more than 10 percent of said feed oil boiling above 650° F. is converted to material boiling below 650° F.

15. The process of claim 9 wherein in the hydrodesulfurized oil passed to the cracking riser the ppm by weight of nickel plus 1/5 the ppm by weight of vanadium is less than 1.

16. The process of claim 9 wherein the catalyst in the downstream hydrodesulfurization stage contains a promoting amount of Group IV-B metal.

* * * * *